United States Patent [19]

Tippins et al.

[11] Patent Number: 4,658,363

[45] Date of Patent: Apr. 14, 1987

[54] METHOD OF INCREASING THE PRODUCTIVITY OF REVERSING PLATE MILLS

[75] Inventors: George W. Tippins; Lawrence P. Dunn, both of Pittsburgh; Wayne G. Pottmeyer, Murrysville, all of Pa.

[73] Assignee: Tippins Incorporated, Pittsburgh, Pa.

[21] Appl. No.: 673,881

[22] Filed: Nov. 21, 1984

[51] Int. Cl.[4] ..... B21B 37/12; B21B 41/06

[52] U.S. Cl. ..... 364/472; 364/476; 364/148; 364/152; 364/156; 72/29; 72/199; 72/229; 72/366

[58] Field of Search ..... 364/148, 152, 156, 468, 364/469, 472, 475, 476; 72/199, 229, 29, 365, 366

[56] References Cited

U.S. PATENT DOCUMENTS 3,694,636 9/1972 Smith, Jr. ..... 364/472
3,875,389 4/1975 McFadden et al. ..... 364/472
4,248,072 2/1981 Hasegawa et al. ..... 364/472
4,430,874 2/1984 Tippins et al. ..... 72/229
4,554,635 11/1985 Levine ..... 364/148

*Primary Examiner*—Jerry Smith
*Assistant Examiner*—John R. Lastova
*Attorney, Agent, or Firm*—Webb, Burden, Robinson & Webb

[57] ABSTRACT

A method of improving the productivity and yield of a reversing plate mill comprises installing coiler furnaces on the upstream and downstream sides of the mill. Thereafter, a supply of extra large slabs as well as a supply of pattern slabs for the mill are provided. The plate requirements for the next horizon period are analyzed and for each size plate, a decision is made (i) to process extra large size slabs, or (ii) to process pattern slabs, or (iii) a combination of both extra large and pattern slabs to supply the plate requirements. The slabs are then processed in accordance with the particular decision.

14 Claims, 6 Drawing Figures

METHOD OF INCREASING THE PRODUCTIVITY OF REVERSING PLATE MILLS

FIELD OF THE INVENTION

This invention relates to a method of improving productivity in the rolling of plate and, more particularly, in plate mill lines employing hot reversing mills.

DESCRIPTION OF THE PRIOR ART

Hot rolled steel plate has generally been produced by use of a reversing plate mill rolling from "pattern" slabs to plate. Some plate in the narrower widths are also produced on a hot strip mill.

Reversing plate mills specifically dedicated to rolling "pattern" slabs to plate are generally used for producing wider and thicker plate as compared to a hot strip mill product. It is the usual practice to produce plate on a single stand or a two-stand reversing mill. Each combination of thickness, width, and length of plate rolled from the mill requires a properly proportioned "pattern" slab with the appropriate volume of metal. The slabs are reduced to plates by passing them back and forth through the mill. It is usual to cross roll a slab to achieve the desired plate width. Thereafter the rolled plates are flattened hot on a leveling machine, transferred to a cooling bed for cooling and subsequently side sheared and end sheared to finished plate dimensions. This reduction normally takes place on a four high hot reversing plate mill although it is also common to utilize a two high hot reversing mill upstream of the four high to increase productivity by having two slabs on line at a time.

There is a limitation on existing reversing plate mills utilized in rolling carbon, stainless or specialty steel and nonferrous plates: The lengths that can be rolled are restricted by the cooling rate and the time of rolling. For example, when rolling a 100 inch wide carbon steel plate to 3/16 inch thickness, the usual maximum length that can be rolled is 55 to 65 feet. A typical pattern slab would have a volume of 15,440 cubic inches and would weigh about 4,375 pounds. The same size plate in stainless steel can be rolled to only 40 to 45 feet due to the higher resistance of stainless steel to deformation. If the slab is oversized in weight or size, it may be impossible to finish the plate to the desired thickness and width as the material will become too cold for hot plastic deformation by the rolling mill.

A common problem associated with the rolling of plate on a reversing plate mill is camber. Camber is normally defined as the nonlinearity of the longitudinal edges of the plate. Because of camber, excess rolled width must be provided and then subsequently side trimmed to meet the desired width. This materially reduces the yield obtained. The typical product yield for a plate mill of 112 inches wide for carbon steel plate are about 82 to 86% from the slab to the finished plate.

Since each plate size has a corresponding pattern slab, the reheat furnace must accommodate a wide range of slab sizes to produce the product mix, thereby making heating efficiency and uniformity more difficult. Further, the slab producing facility, whether it be continuous caster or a blooming or slabbing mill must turn out a large number of small size slabs for subsequent processing into the plates. For example, a typical 112 inch wide plate mill requires approximately 30,000 slabs for each 100,000 tons of plate production.

All of these are further compounded by the typical market demand for carbon steel plate wherein some 50% of the demand is for plate which is ½ inch thick or less. To meet this market the reversing plate mill must roll many small slabs (2 to 3 tons) at a resultant low production rate and with a low product yield.

The slabs must be obtained from a slabbing mill or continuous caster, cut to "pattern" dimensions, marshalled in the plate mill slab yard and charged into the plate mill furnace in the proper rolling sequence. Therefore, in addition to low production rate and yield, substantial costs are involved in the repeated handling and marshalling of many small slabs.

SUMMARY OF THE INVENTION

Briefly, according to this invention, there is provided a method of improving the productivity of a conventional single stand or two-stand reversing plate mill. The method provides a substantial increase in product yield which lowers unit manufacturing costs and conserves raw material, energy and other resources. By handling larger slabs (on the order of 30 to 40 tons), the plate mill results in more uniform heating practices and increased utilization of the reheat furnace and increases the productivity of the processing units which transform the metal product to a slab. Handling of larger slabs can have a drawback: excess plate cannot be immediately shipped but must be inventoried. Inventory involves a substantial expenditure. The method according to this invention minimizes increased inventory expenses over the costs saved by rolling larger slabs. Further, the method can be applied to existing plate mills through a simple conversion or can form a part of new installations.

According to this method, coiling furnaces are installed upstream and downstream of a reversing plate mill which already includes shearing means and finishing means positioned downstream of the mill for final processing of the plate product. The slab reheat furnace required for all plate mills remains unchanged upstream of the upstream coiler furnace except it will now be used for large slabs rather than the small "pattern" slabs. In one mode, the reversing mill is used to roll traditional size pattern slabs in the usual manner. In other words, the coiler furnaces remain unused or idle. In a second mode, however, extra large slabs (substantially larger than the typical pattern slabs) are rolled as follows: the slab, after being heated to a desired rolling temperature, is passed back and forth through the hot reversing plate mill to obtain a workpiece of a desired intermediate thickness and length. When the desired intermediate workpiece is achieved, one of the coiler furnaces is activated and the workpiece is thereafter coiled within the furnace. The workpiece is thereafter passed back and forth through the hot reversing plate mill between the two coiler furnaces until the desired final plate thickness has been achieved. On the last pass, the hot coiled plate is rolled flat and then further processed into the desired plate length, multiples thereof, or coil plate. The coiler furnaces can be positioned either below or above the pass line and means such as deflector plates are employed to direct the workpiece into the coiler furnaces. Pinch rolls may be used for feeding and to assist in maintaining tension on the strip as it is being rolled and means such as a mechanized feed roll is provided to maintain the workpiece out of engagement with the rolls during payoff to the shear.

Thus the method according to this invention comprises improving the productivity of a reversing plate mill by first installing coiler furnaces upstream and downstream of the plate mill and then operating the plate mill in one of two modes according to the requirements for particular grades and sizes of plate. In the first mode, the mill is operated on conventional pattern slabs to produce plates. In the second mode, extra large slabs are rolled in the reversing mill with the slabs being passed back and forth between coiler furnaces at least a portion of the time. The strip is finished into coil plate or plate product by conventional means.

It is a necessary step according to the method of this invention to provide a supply of extra large slabs as well as a supply of pattern slabs. Extra large slabs are those too big to be rolled in a conventional reversing mill process. Pattern slabs are those slabs that may be rolled in a conventional rolling mill. The maximum size of the extra large slabs depends upon the size of the coiler furnace and, of course, any upstream limitations. Slab weights on the order of 30 to 40 tons are most practical and are rolled most efficiently.

Plate is ordered by finished size dimensions. Therefore it is essential to analyze production orders and shipping schedules and coordinate the analyses with the actual running of the plate mill. In this regard, a computer is essential.

A key step in the method according to this invention is determining when to roll an extra large slab to satisfy at least a portion of existing plate requirements and when to roll pattern slabs by the conventional rolling process. This is accomplished by analyzing all the requirements for a particular size and grade of plate for a horizon period, say two weeks. The external requirements are reduced by the available inventory, if any. In this regard, it must be recognized that plate mill inventory is generally small at best. Once or both modes are used to reduce the cost of an inventory and increase the costs saved by rolling extra large slabs.

Preferably, according to this invention, the step for determining when to roll an extra large slab is implemented with the aid of a programmed general purpose digital computer. The computer is programmed to calculate the fraction or number plus fraction of extra large slabs needed to satisfy the plate requirements for each size and grade required. If less than an entire extra large slab is needed to fulfill the plate requirements, the fraction is compared to a threshold (R) and if falling below the threshold, the plate is rolled conventionally from pattern slabs but if the fraction exceeds the threshold, the plate is rolled from an extra large slab by use of the coiling furnaces and the excess plate, if any, is placed in inventory. The threshold is adjusted to minimize the cost of inventory and increase the costs saved by rolling extra large slabs.

According to one preferred method, the threshold for the next horizon period is obtained by first calculating the optimum thresholds for at least one prior horizon period and using the averaged optimum threshold to schedule the next horizon period. A threshold may be established for all sizes and grades or individual thresholds may be established for each size and grade. The advantage of individual size and grade thresholds based on several prior periods is that the inventory turn-over of each plate type is a factor in the cost of inventory.

DESCRIPTION OF THE PREFERRED EMBODIMENTS

Figure 1:
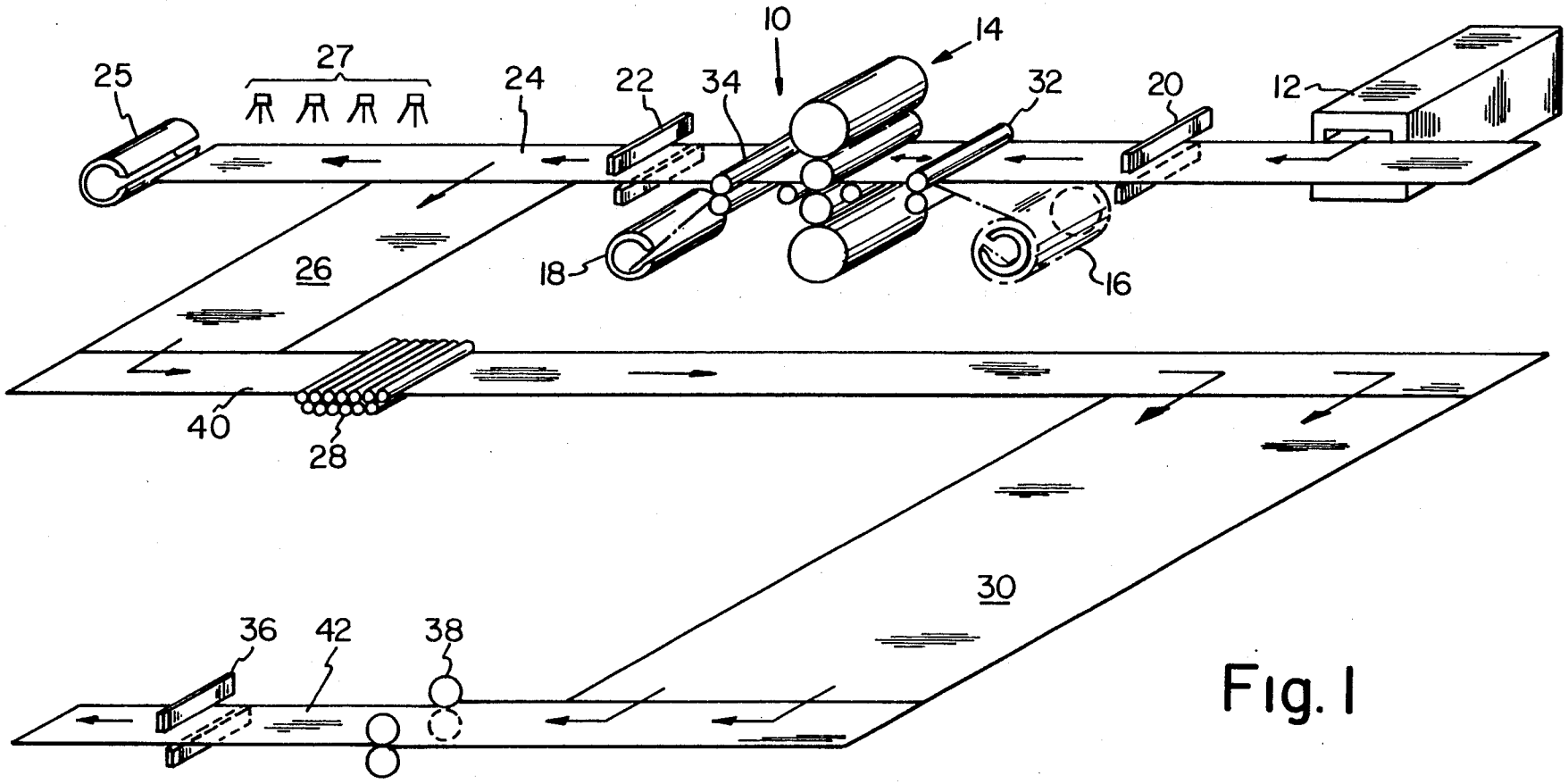
FIG. 1 is a schematic of the layout of one possible configuration of a plate mill useful according to this invention.

Referring to FIG. 1, there is shown apparatus useful for the practice of the method disclosed herein. Slabs are heated to rolling temperature in a reheat slab furnace 12. The slabs are normally pushed out of furnace 12 onto a conveyor line 24, also termed a mill table. The four high hot reversing plate mill 14 is positioned downstream of the furnace 12. Pinch roll pairs 32 and 34 are located on each side of hot reversing plate mill 14 and assist in decoiling as will be described hereinafter. Coiler furnaces 16 and 18 are also positioned on either side of the four high hot reversing plate mill 14. A conventional shear 20 may be positioned between coiler furnace 16 and the slab reheat furnace 12 and a conventional shear 22 which may be an upcut, downcut or flying shear is positioned downstream of the coiler furnace 18. Conveyor line 24 terminates in a transfer table 26 for moving the plates onto a parallel processing conveyor line 40 or continues through water sprays 27 and onto coiler 25. Processing line 40 includes a conventional roller leveler 28 for leveling the plate. A third conveyor line 42 parallels lines 24 and 40 and is connected to line 40 through a transfer cooling bed 30 located along the terminal portion of conveyor line 40. Conveyor line 42 includes a side shear 38 and a final end shear 36 for cutting the plate into the final desired length. If the product is rolled directly into coil plate on coiler 25, the product is transferred to an appropriate finishing line.

Figure 2:
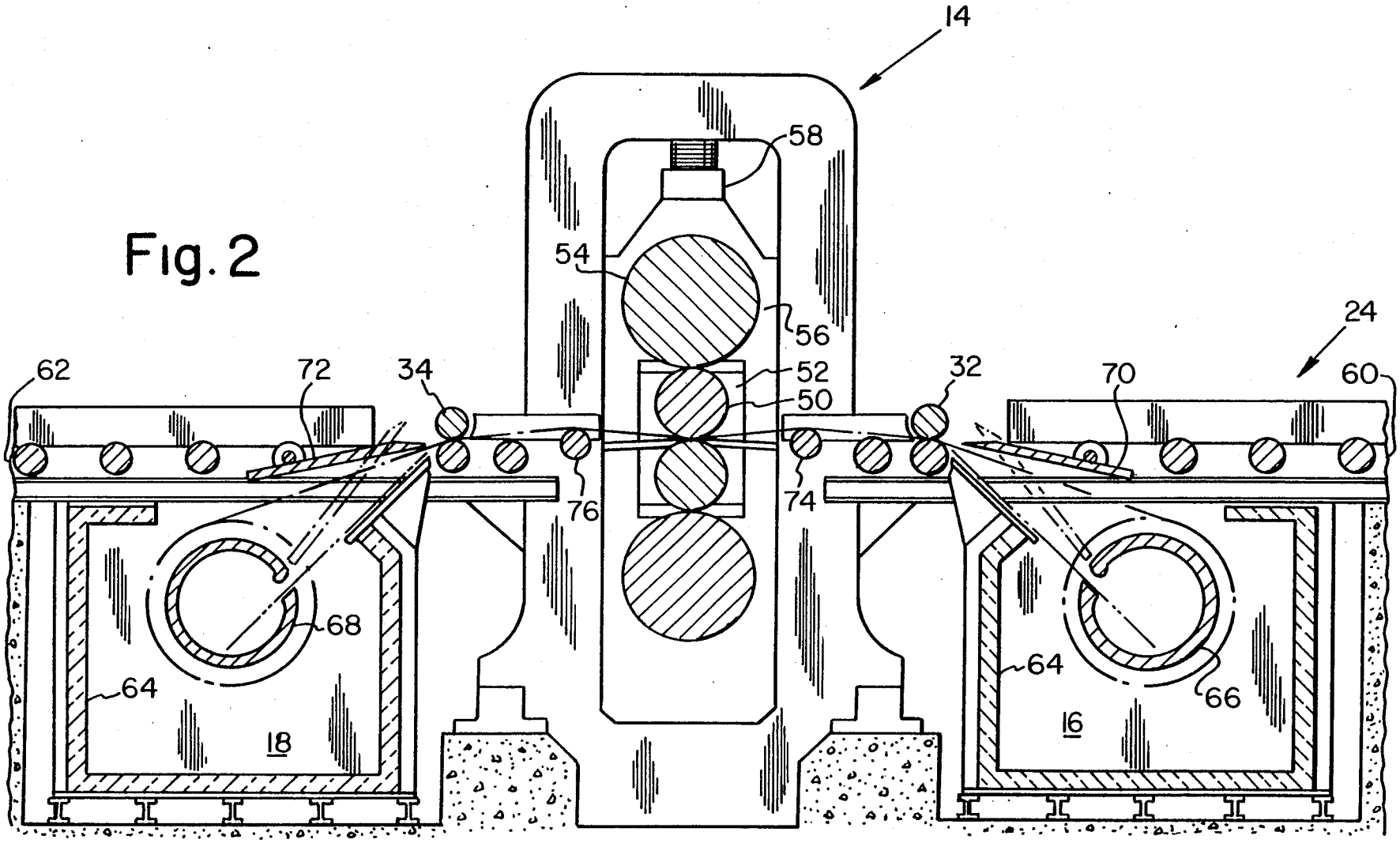
FIG. 2 is a schematic, partly in section, showing the hot reversing mill and the two coiler furnaces.

The details of the hot reversing plate mill 14 and the coiler furnaces 16 and 18 are shown in FIG. 2. The hot reversing plate mill 14 is conventional having a pair of work rolls 50 journaled in work roll chucks 52 and a pair of backup rolls 54 journaled in backup chucks 56. A hydraulic automatic gauge control system 58 can be used to control the rolling thickness in the conventional manner or a motor driven screw-down mechanism can be utilized.

Pinch roll pairs 32 and 34 are operable on each side of and adjacent to the mill 14. Immediately adjacent to and on each side of the pinch roll pairs 32 and 34 are the coiler furnaces 16 and 18, respectively. The coiler furnaces 16 and 18 are illustrated as mounted below the front and back mill tables 60 and 62, respectively, which make up a part of conveyor line 24. This positioning is preferable since the coiler furnaces are located in a position to not interfere with the conventional flat rolling conducted in the early passes. When converting an existing mill it may be necessary to locate the coiler furnace above the mill tables.

Each coiler furnace, 16 and 18, is lined with a light-weight fiber type refractory lining 64, which because of its low heat sink value, is responsive to modulating heat input. Of course, other conventional linings can be employed. Each coiler furnace 16 and 18 includes coilers 66 and 68, respectively. The coilers 66 and 68 can be any one of several conventional types including motor driven coiling reels, or even mandrelless coilers.

Located at the entrance of each coiler furnace 16 and 18 and adjacent to the pinch roll pairs 32 and 34 are deflector plates 70 and 72, respectively. These deflector plates lie in a plane below the mill tables 62 and 64 and when activated by the operator or automatic controls pivot into the open position so as to deflect the plate being rolled into the coiler furnaces.

The first table feed rolls 74 and 76 on each side of the mill are vertically operable by conventional means to lift the running plate out of contact with the bottom work roll 50.

According to a first mode of operation, the coiler furnaces stand idle and pattern slabs are rolled to plate in the above described apparatus in the traditional manner: After heating in the reheat furnace, pattern slabs are passed back and forth through the reversing mill until they are reduced in thickness to the desired plate thickness. Thereafter, they are side trimmed and further trimmed at both ends.

According to a second mode of operation, an extra large slab is initially rolled straight away through the hot reversing plate mill 14. The slab is then reduced by rolling it back and forth through the mill in a conventional manner until a thickness of approximately $1\frac{1}{4}$ inches to $\frac{1}{2}$ inch is obtained, at which time the deflector plates 70 and 72 are activated and the reduced slab will enter into one of the coiler furnaces 16 or 18 for winding onto the mandrel or other coiling mechanism. The shears 20 and 22 on either side of the coiler furnaces permit the cropping of the ends of the elongated slab before it is reduced to the thickness at which it enters the coiler furnaces. Thereafter, the coiled plate is passed back and forth between the coiler furnaces and through the hot reversing plate mill 14 until such time as the plate is reduced to the desired finished plate thickness. As the plate is wound on the mandrel in the coiler furnace, the exposed surface area of plate is greatly reduced as each wrap covers the preceding wrap. The end of each plate is retained by the pinch rolls for feeding into the roll bite for the next pass through the mill.

The penultimate rolling pass through the mill is usually in the reverse direction so that the entire plate is coiled on the front furnace mandrel 16 except for the front end of the plate which is retained between the front pinch rolls 32. The plate is then uncoiled from the coiling furnace 16 with the aid of the pinch rolls and is cut into the desired length by the shear 22. The shear 22 can be a flying shear or a stationary shear. If a flying shear is used, the plate runout table has to be long enough so that a running gap can be opened up between the back end and the front end of the cut lengths of the plate to provide sufficient time for a plate takeoff mechanism (not shown) to remove the plate from the runout table.

Other coiler furnace designs can be employed to modify the plate rolling procedures after the final reduction in thickness has been achieved. For example, the downstream coiler furnace 18 can be of the type which coils in one direction from the mill 14 and pays off in the other direction to the crop shear 22. In this embodiment the mill 14 can be used for the early passes while the coiler furnace 18 pays off the previously rolled plate in coil form to the crop shear 22.

Where a stationary shear is employed, the runout table need not be much longer than the cut length. In this case the rolling mill rolls are open so that the finished plate can pass freely through the roll bite when the plate is unwound from the front coiler by the pinch rolls. The liftable first table feed roll 34 prevents the plate from rubbing on the bottom mill roll.

As the plate is unloaded from the furnace mandrel, it is cut to cooling bed length by the stationary shear in a start-stop cut manner. The speed of withdrawal of the coiled plate depends on the type of cutting shear, the length of cut, the speed of the plate pushoff transfer mechanism and the production rate required. The length of the plate cut by the shear 22 is normally in accurate multiples of ordered shipping lengths. The plate then travels down the runout table 22 and is transferred laterally as quickly as possible onto transfer bed 26 to make room for the following length. The operation of the shear 22 can be actuated from controls receiving information from a digital counter on the discharge pinch roll 18. The plate then travels through the plate leveler 28 across the cooling bed 30 and through the side trimmer 38 and end shear 36 on conveyor line 42 to shear the length and width to the desired size.

Figure 4:
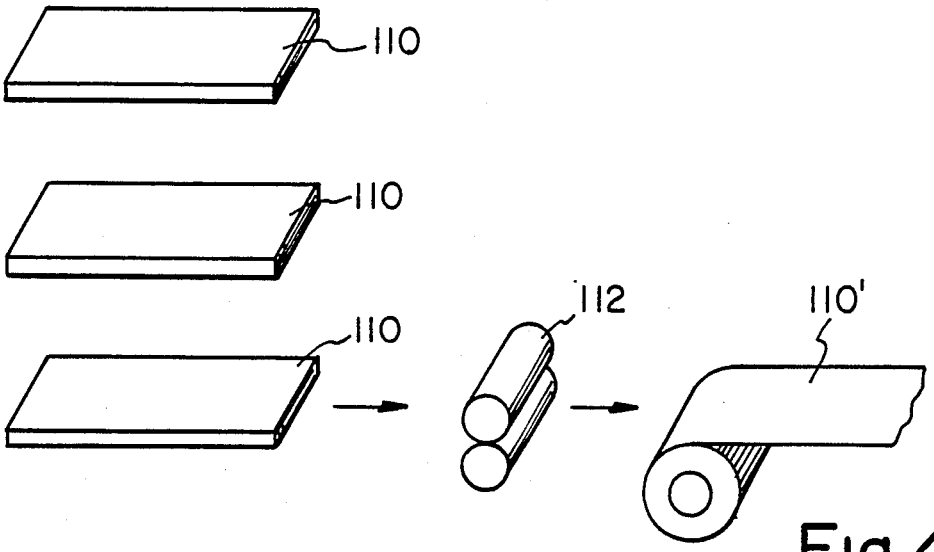
FIG. 4 is a schematic of the slab processing of the present invention.
Figure 3:
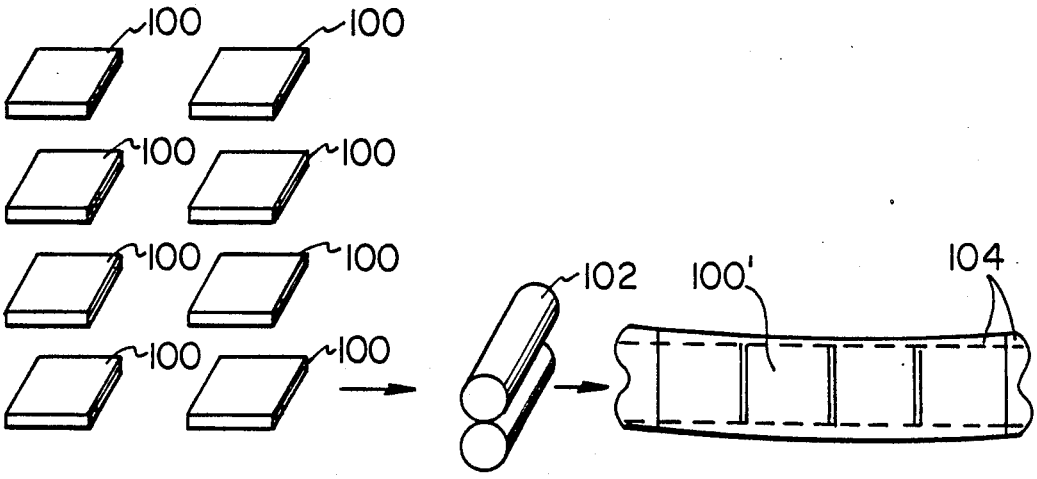
Fig. 3 PRIOR ART
FIG. 3 is a schematic of the prior art conventional plate mill process.

The difference between the subject invention and the prior art conventional plate mill is illustrated in FIGS. 3 and 4. The conventional plate mill requires on the order of 30,000 slabs per 100,000 tons of production. A series of small pattern slabs 100 having an average weight of 3.3 tons and a general range of 2 tons to 11 tons are rolled through a hot reversing plate mill 102 to form a rolled plate which will range in length from 60 to 120 feet, FIG. 3. The rolled plate has to be side and end sheared to form the finished plate 100' and the scrap 104 is discarded. Plate 100' can be sheared into smaller plate in a finishing operation as required.

The subject invention includes rolling slabs 110 on the order of 30 tons and greater through a hot reversing plate mill 112 to form coil plate 110' on the order of 1,000 to 1,700 feet. Since the average extra large slab is 30 tons or more, the number of slabs needed per 100,000 tons is reduced to approximately 3,300 slabs which, of course, requires less handling and marshalling. The coil plate is then cut into finished plate. In many cases, the product can be sold as mill edge or with a minimum side trim if required. The yield is on the order of 94 to 96%.

The relative productivity for each mode (Mode I and Mode II) is shown in Table 1. The yield and production in tons per hour are much greater for Mode II. The increased overall product yield from about 86% (Mode I) on a conventional mill to about 96% (Mode II) results as follows: Since the plate is rolled under tension in Mode II while it is wound in the coiler furnace, there is very little camber from end to end of the plate which is 1,000 feet and longer. This means the scrap allowance for side trimming can be reduced to a minimum value and there are only two ends of the plate to be cropped as compared to many ends when rolling pattern slabs in Mode I.

The benefits of the extra large slabs back up all the way through the primary mills and steelmaking facilities where the manufacture of large ingots and slabs, be they cast or rolled, lower the overall manufacturing cost per ton of product produced. And the plate produced is a high quality product having been rolled in long lengths under tension and accurate temperature control for precise physical properties. Further, since the plate is generally rolled to uniform width from end to end, it is free of camber. Therefore, it may not be necessary to side trim the plate for those customers who can utilize a "mill edge" in their fabrication process. In this case, slab to finish plate yield approaches 95 to 96%.

TABLE 1

| | Data for Producing a 96" Wide Plate on Single Stand Plate Mill | | | | | | | |
|---|---|---|---|---|---|---|---|---|
| | 112" Plate Mill (Mode I) | | | | 112" Plate Mill (Mode II) | | | |
| Plate Thickness | Slab Size" | Wt. Tons | % Yield | Tons/ Hr. | Slab Size" | Wt. Tons | % Yield | Tons/ Hr. |
| 3/16" | 6 × 33 × 78 | 2.19 | 86.7 | 31.9 | 10 × 98 × 288 | 40 | 96.6 | 177 |
| ¼" | 6 × 40 × 100 | 3.40 | 86.4 | 49.4 | 10 × 98 × 288 | 40 | 96.9 | 220 |
| 5/16" | 6 × 64 × 100 | 5.44 | 86.3 | 78.3 | 10 × 98 × 288 | 40 | 96.5 | 240 |
| ⅜" | 6 × 77 × 100 | 6.54 | 86.0 | 107.8 | 10 × 98 × 288 | 40 | 96.3 | 266 |
| ½" | 8 × 69 × 100 | 7.82 | 86.6 | 130.4 | 10 × 98 × 288 | 40 | 96.2 | 319 |
| ⅝" | 8 × 86 × 100 | 9.75 | 86.9 | 163.4 | 10 × 98 × 276 | 38 | 95.8 | 340 |
| ¾" | 8 × 100 × 104 | 11.79 | 85.0 | 193.3 | 10 × 98 × 260 | 36 | 95.2 | 364 |

On looking at Table 1 might at first consider that all plate should be made using the extra large slabs and Mode II. However, that would ignore the realities of the marketplace. The product mix varies from mill to mill and from time to time. If all plate products are made in Mode II, large inventories will be accumulated for those products in less demand. The cost of maintaining the inventory can exceed the costs saved by rolling extra large slabs with Mode II.

Figure 6:
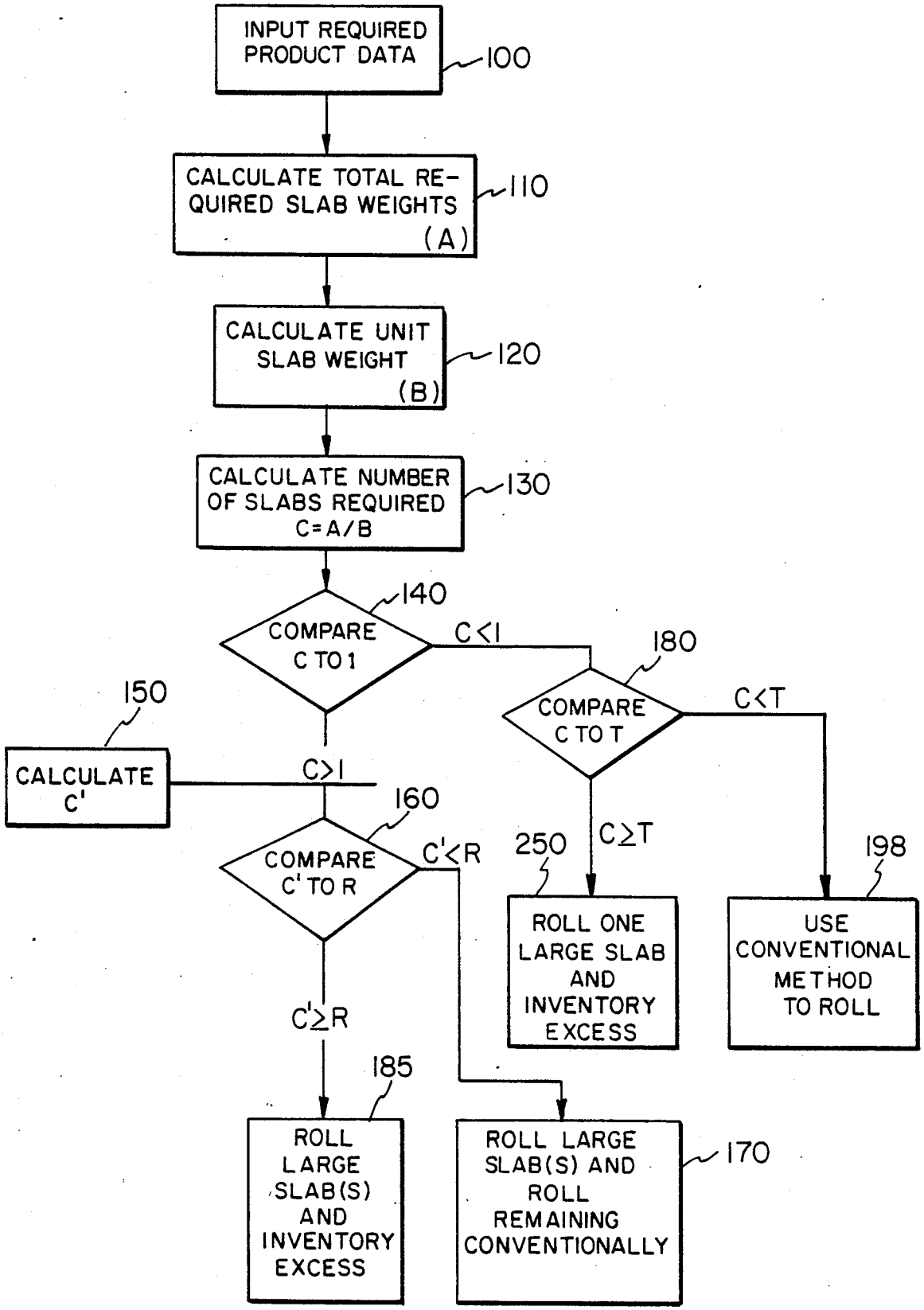
FIG. 6 is a flow diagram of a procedure for establishing whether the plate requirements are satisfied from the first or second mode of reversing mill operation.

Referring now to FIG. 6, there is shown a flow diagram for a computer program implementation of a portion of applicants' process for improving the productivity of a reversing plate mill. The starting point is to input all required product data for the horizon period as well as the makeup of the existing inventory. The data input at step 110 (see FIG. 3) builds two tables (a requirements table and an inventory table) containing the same minimum information; namely, the type of steel (grade), the thickness and other dimensions of each plate required or inventoried and the total number of each type and size plate required or inventoried. These tables serve as a source of raw data for further use.

From the data input at step 100, for each size and grade plate, the total required slab weights (A) assuming rolling of extra large slabs is calculated at step 110. The inventory is used to reduce the size of the required product prior to this calculation. The unit slab size for extra large slabs (B) is calculated at step 120 from parameters stored in for available slab thicknesses (e.g. 8 inch, 10 inch, and 14 inch slab thicknesses). The number of slabs required are then calculated at step 130 ($C=A/B$). If C exceeds one (step 140), these slabs are scheduled for rolling to the desired plate size. Then, the weight C' required for completing the order is calculated at 150. C' is simply the remainder resulting from the calculation of A divided by B.

At 160, C' is compared to threshold R which will be explained hereafter. If C' does not exceed threshold R then the remainder of the order is rolled conventionally from pattern slabs at step 170. If C' exceeds or equals threshold R, the remainder of the order is obtained by rolling one more extra large slab and inventorying the excess at step 185.

If an entire extra large slab will not be consumed by a plate requirement (as determined by the condition C is less than 1 at step 140), then C is compared to a threshold T (which will be explained hereafter) at step 180. If C is less than T then the conventional method of rolling plate from pattern slabs is used to fill a requirement at step 198. If, however, C is equal to or greater than T, then an extra large slab is rolled and the excess is inventoried at step 200. Of course, steps 100 through 200 must be repeated for every steel type and plate dimension required in the horizon period.

Thresholds R and T are selected to minimize the total of the cost of inventory less the cost saved by rolling extra large slabs. This depends upon a number of considerations, for example, difference in the cost per ton of plate made conventionally and the cost per ton of plate made by rolling extra large slabs. It also depends upon the expected residence time of the plate residing in inventory and the cost of holding inventory which, of course, depends upon the cost of borrowing money to support the inventory. The expected residence time may depend on a particular plate type and thus the values of R and T may be established accordingly. Inventory can also be influenced by controlling the slab length. In other words, the slab length is determined which will minimize the occurrence of any inventory in the first instance.

In a study of an established plate mill over a period of three months, it was determined that the maximum savings occurred if R and T were both at 0.6. It appears that the value 0.6 is an excellent starting selection for thresholds R and T and that the process can be further optimized by adjusting R and T according to experience. The adjusting process simply involves incrementally varying R and T and calculating savings or increased productivity as would have been obtained for preceding horizon periods. The optimum R and T values for the preceding periods are thus identified. The average of the optimum R and T values for the preceding horizon periods may be used for following horizon periods. Varying R and T varies the ratio of extra large slabs to pattern slabs being rolled. The yield and the cost per ton of handling extra large slabs versus pattern slabs are factors known in each mill enabling the calculation of savings or increased productivity for preceding periods by varying R and T incrementally. Exemplary data is set forth in Table I.

After the slab selection process is completed according to the portion of applicants' method described with reference to FIG. 6, the scheduling of slabs and plates is completed for the horizon period with the widest plates being first scheduled and the subsequently thinner plates scheduled thereafter as is well established procedure.

Figure 5:
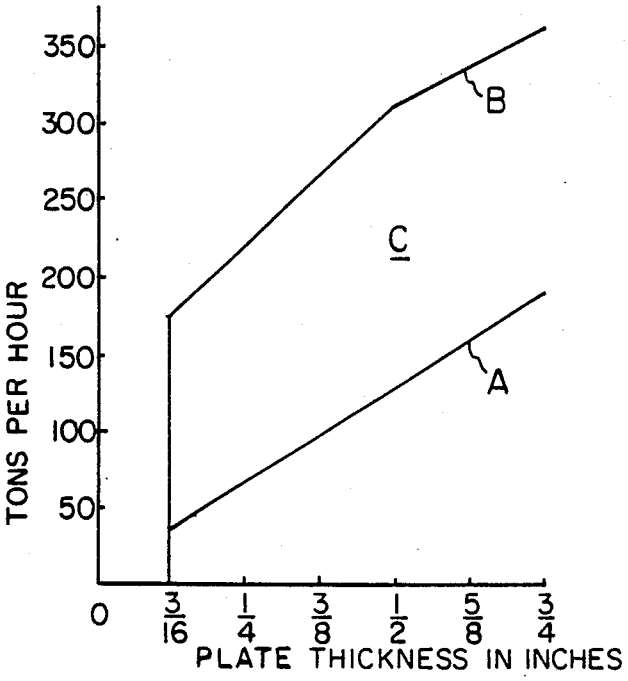
FIG. 5 is a graph comparing productivity of a prior art mill with the processing method of the present invention.

The improvement in productivity using the subject invention is illustrated in the graph of FIG. 5. The productivity of an existing 112 inch conventional single stand reversing plate mill operating with optimum slab size in accordance with standard practice is shown by line A of the graph. That same mill modified and operated in accordance with the subject invention would have a productivity as illustrated by line B. The increase in productivity over the various plate thicknesses is represented by area C between lines A and B of the graph.

The subject invention was applied to an existing facility for the production of 41,000 tons of ordered finished plate. The results are shown in Table 2.

TABLE 2

| Example of Savings by Utilization of Invention | |
|---|---|
| Source Data: | |
| 41,000 tons of plate rolled by conventional method | |
| Input Data: | |
| Threshold | .60 |
| Horizon period | 1 week |
| Shipping period | 12 weeks |
| Rounding | .60 |
| Slab Thickness | 10 inches |
| Results: | |
| 77% produced and shipped via invention | |
| 23% produced and shipped via conventional method | |
| 95% yield for product produced by invention | |
| 27% reduction in net manufacturing cost | |

The 27% cost savings represents a savings of approximately $70.00 per ton shipped at today's costs. These savings take into account only productivity and yield. In addition, further savings are realized by the substantial decrease in handling costs for the supply and marshalling of the lesser number of slabs.

As used in the claims, "to maximize productivity" means to maximize savings resulting from rolling extra large slabs considering the increased cost of inventory, if any, resulting therefrom.

We claim:

1. A method of improving the productivity of a reversing plate rolling mill by scheduling processing of a combination of extra large and pattern slabs during a next horizon period based upon the plate output requirements of the rolling mill comprising:

(a) installing coiler furnaces of the upstream and downstream sides of the mill;

(b) providing a supply of extra large slabs as well as a supply of pattern slabs for the mill;

(c) analyzing the plate requirements for the next horizon period and for each size plate making a decision:

(i) to process extra large size slabs, or (ii) to process pattern slabs, or (iii) a combination of both extra large and pattern slabs to supply the plate requirements;

(d) processing the extra large slabs by passing them back and forth through the rolling mill taking up the slabs in the coiler furnaces on at least a portion of the passes;

(e) processing the pattern slabs by passing them back and forth through the mill while the coiler furnaces remain idle;

(f) satisfying the plate requirements from the output of the rolling mill during steps (d), (e) or both and sending the excess plate, if any, to inventory;

(g) repeating steps (a) through (f) while in step (c) considering the plate requirements for the next horizon period.

2. A method according to claim 1 wherein the decision in steps (c) or (g) whether to process extra large slabs is based on the following procedure:

if the entire plate output from an extra large slab will be consumed in meeting the requirements for the plate size adjusted for the amount of plate of that plate size in inventory then processing an extra large slab;

if more than a variable R times the plate output from an extra large slab but less than the entire slab will be consumed in meeting the requirements for plate of the size when adjusted for plate of that size in inventory, then processing the extra large slab and passing the excess plate to inventory and if less than R times the plate output from an extra large slab will be consumed, then processing one or more pattern slabs;

wherein R is selected between 0.5 and 0.7.

3. A method according to claim 2 wherein R is adjusted over a period of time to maximize productivity.

4. A method according to claims 1, 2, or 3, wherein the horizon period is between 1 and 6 weeks.

5. A method according to claim 2 wherein the horizon period is experimentally adjusted to the number of weeks that maximize productivity.

6. A method according to claim 2 wherein the maximum possible savings versus R is calculated for at least one preceding horizon period and the optimum R value for each period is identified and based upon an average of the optimum R values for said at least one preceding period establishing the R value to be used in the next horizon period.

7. A method according to claim 2 wherein the decision of steps (c) or (g) comprises:

(a) for a given size of plate ordered, calculating the weight (A) of the slab required to produce the plate from the dimensions of the plate considering head and tail losses;

(b) calculating unit slab weight (B) of the extra large size slabs available;

(c) calculating the ratio C being the quantity A divided by weight B;

(d) if C is greater than 1, then rolling extra large slabs, but if C is less than 1:

(i) and if C is less than a variable T, then rolling pattern slabs but (ii) if C is greater than or equal to T, then rolling an extra large slab and passing the excess plate to inventory.

8. A method according to claim 7 wherein the maximum possible savings versus T is calculated for at least one preceding horizon period and based upon an average of the optimum T value for said at least one preceding period establishing T to be used in the next horizon period.

9. A method according to claim 1, wherein the decision in steps (c) or (g) whether to process extra large slabs is based upon the following procedure:

calculate an integral number and fraction or fraction alone of extra large slabs that will be required to provide enough plates to satisfy a given requirement considering the amount, if any, of that size of plate currently in inventory;

if less than 1 extra large slab is required, compare the fraction alone to a first threshold value T and if the fraction alone equals or exceeds a threshold value T satisfying the requirement from an extra large slab and passing any excess to inventory;

if the fraction alone is less than the threshold value T, satisfying the requirement from pattern slabs;

if one or more extra large slabs are required to satisfy the order, roll the integral number of extra large slabs required and satisfy the remainder of the requirement as follows: comparing the fraction to a second threshold value R and if the fraction equals or exceeds the threshold value R satisfying the remainder requirement from an extra large slab; and passing any excess to inventory;

if the fraction is less than the threshold value R, satisfying the requirement from pattern slabs.

10. A method according to claim 9 wherein R and T are adjusted over a period of time to maximize productivity.

11. A method according to claim 9 wherein the maximum possible savings versus threshold values R and T are calculated for at least one preceding horizon period and the optimum R and T values for each period are identified and based upon an average of the optimum threshold values for R and T establishing the threshold values to be used in the next horizon period.

12. A method according to claims 2, 7, or 9 wherein thresholds are established differently for different types and grades in order to maximize productivity.

13. A method according to claim 1 wherein the extra large slabs are on the order of 30 to 40 tons.

14. A method according to claim 13 wherein the pattern slabs are on the order of 2 to 11 tons.

* * * * *

UNITED STATES PATENT AND TRADEMARK OFFICE

CERTIFICATE OF CORRECTION

PATENT NO. : 4,658,363

DATED : April 14, 1987

INVENTOR(S) : George W. Tippins et al.

It is certified that error appears in the above-identified patent and that said Letters Patent is hereby corrected as shown below:

Column 1 Line 56 "yield" (second occurrence) should read —yields—.

Column 3 Line 39 "Once" should read —One—.

Column 7 Line 23 "On" should read —One—.

Column 7 Line 38 "step 110" should read —step 100—.

Claim 1 - Column 9 Line 45 "of" should read —on—.

Column 11 is double spaced. These lines should be single spaced.

Signed and Sealed this

Nineteenth Day of January, 1988

*Attest:*

DONALD J. QUIGG

*Attesting Officer*

*Commissioner of Patents and Trademarks*